United States Patent [19]

Gaynor

[11] Patent Number: 4,911,183

[45] Date of Patent: Mar. 27, 1990

[54] CIGARETTE FRESHENING PROCESS

[76] Inventor: Dalton Gaynor, P.O. Box 965, Sheridan, Wyo. 82801

[21] Appl. No.: 113,055

[22] Filed: Oct. 27, 1987

[51] Int. Cl.[4] ..... A24B 1/00; A24F 13/00; A24F 17/00

[52] U.S. Cl. ..... 131/300; 131/329

[58] Field of Search ..... 131/329, 290, 300

[56] References Cited

U.S. PATENT DOCUMENTS 3,266,499 8/1966 Canan ..... 131/300

4,233,995 11/1980 Kotuby et al. ..... 131/300

*Primary Examiner*—V. Millin

*Assistant Examiner*—Jennifer L. Doyle

*Attorney, Agent, or Firm*—Leon Gilden

[57] ABSTRACT

A compact easily transported container is utilized to freshen cigarettes once a package thereof has been opened and subjected to deterioration by exposure to air. An open package of cigarettes is positioned in the lowermost portion of a split container whereupon a top portion is secured thereto in a sealed interfitting relationship. A securably closable mouthpiece is opened whereupon an individual smoking a cigarette merely directs a volume of exhaled breath directly into the container and secures a hinged lid thereto to seal the container. The thusly injected exhaled breath assists in maintaining cigarette freshness and limiting deterioration of remaining cigarettes in the package.

4 Claims, 1 Drawing Sheet

CIGARETTE FRESHENING PROCESS

BACKGROUND OF THE INVENTION

1. Field of the Invention

The present invention relates to freshening process, and more particularly pertains to a new and improved process through which when utilized maintains freshness of a package of cigarettes minimizing loss thereof due to normal deterioration of cigarettes once opened and exposed to drying air conditions.

2. Description of the Prior Art

Various process of maintaining freshness to contents by positioning them within a container is well known in the prior art. These devices normally are of a sealing air-tight to securely contain contents positioned therein. While being beneficial in the prevention of accelerated loss of content subjected to the deterioration when exposed to air, they lack a means of reversing the drying process once begun. For example, U.S. Pat. No. 1,560,243 to Kaczorowski sets forth the use of a cigarette container utilizing a separate compartment for securement of matches. While of useful construction and durable in nature, the patent does not provide any manner of reversing an inescapable drying process of cigarettes once opened and exposed to the affects of drying air.

U.S. Pat. No. 1,714,877 to Kaufman illustrates yet another container for this sealing enclosure of contents therein, such as cigarettes and matches, and whose inner surface is lined to limit exposure of the contents once secured therein to the deterioration of drying air but as in the other patents, this reference does not provide any means or manner of reversing the drying of the contents.

U.S. Pat. No. 1,789,088 to Soperonyi illustrates yet another securement container for the storage of various articles, such as cigarettes, matches and cosmetics, particularly used in a bather and proximate moisture associated with that activity. Essentially the patent sets forth a water-tight container in the same manner of invention as the aforenoted references.

U.S Pat. No. 1,851,057 to Picker is yet another cigarette case formed with a medially positioned cigarette lighter attachment. Essentially the Picker invention is yet another water-proof case with the additional feature of a lighter means formed therewith.

U.S. Pat. No. 2,063,103 to Kaiser, et al. illustrates the use of a compartmentalized securement container for the housing therein of cigarettes in one compartment and matches in an adjacent compartment for subsequent use. This patent, as is the others, is silent as to the matter of reversing a deterioration process of the contents, particularly the cigarettes.

U.S. Pat. No. 2,586,740 to Swanson sets forth yet another water-proof container for the securement of cigarettes therein. This particular container is of a flat configuration so as to be attachable to a bathing suit, for example, for use by a bather.

U.S. Pat. No. 2,836,288 to Atchison and U.S. Pat. No. 3,121,508 to Case are merely further examples of moisture proof cigarette containers of varying shapes for mere housing of cigarettes therein to prevent further deterioration of the contents. Again, however, the problem of preserving the contents while reversing a drying process that has already begun is not addressed by these references.

As such it may be appreciated that there is the continuing need for a new and improved cigarette securement process which addresses both the problem of storage and refreshening of cigarettes positioned therein, the present invention substantially fills the need.

SUMMARY OF THE INVENTION

In view of the foregoing disadvantages inherent in the known types of containment processes now present in the prior art, the present invention provides an improved cigarette freshening process. As such, the general purpose of the present invention, which will be described subsequently in greater detail, is to provide a new and improved cigarette freshening process which has all the advantages of the prior art cigarette freshening processes and none of the disadvantages.

To attain this, the present invention utilizes a multi-section cigarette container of internal dimensions to substantially exceed those of a package of cigarettes by a ratio of 1.1 to 2.5 to 1. A hinged closure enables the directing of exhaled breath by a user to interior of the container housing an opened package of cigarettes. The action of the moist exhaled breath tends to preserve and even freshen cigarettes.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course. additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cigarette refreshener process which has all the advantages of the prior art cigarette refreshener process and none of the disadvantages.

It is another object of the present invention to provide a new and improved cigarette refreshener process which may be easily and efficiently manufactured and marketed.

It is a further object of the present invention to provide a new and improved cigarette refreshener process which is of a durable and reliable construction.

An even further object of the present invention is to provide a new and improved cigarette refreshener process which is susceptible of a low cost of manufacture with regard to both materials and labor, and which accordingly is then susceptible of low prices of sale to the consuming public, thereby making such cigarette refreshener process economically available to the buying public.

Still yet another object of the present invention is to provide a new and improved cigarette refreshener process which provides in the apparatuses and methods of the prior art some of the advantages thereof, while simultaneously overcoming some of the disadvantages normally associated therewith.

Still another object of the present invention is to provide a new and improved cigarette refreshener process wherein a separate container is configured for positioning of a cigarette package therein whereafter exhaled breath is injected to refreshen the cigarettes upon sealing the case and exhaled breath within it.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5, 6:
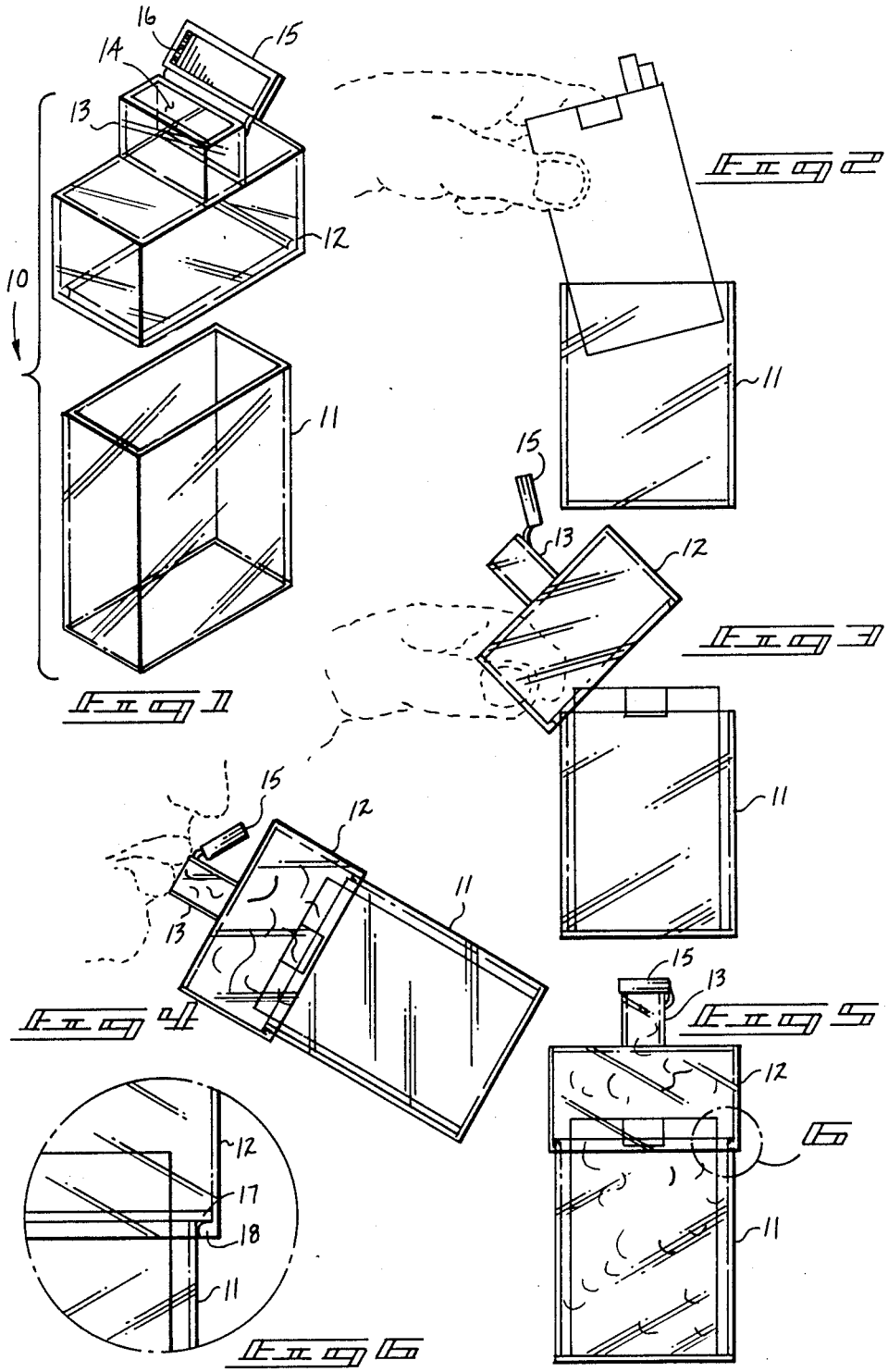
FIG. 1 is an illustration of the container utilized in the practice of a process in an exploded view illustrating its various parts, configuration and relationship.
FIG. 2 is a side orthographic side view of the invention in an initial step in the practice of my invention illustrating the positioning of a package of open cigarettes within my container.
FIG. 3 is a side orthographic side view of the invention illustrating additional step of my invention wherein the upper portion of my container is positioned over the lowermost portion of the container.
FIG. 4 is an orthographic side view in the practice of my invention illustrating the injection of a volume of exhaled breath within my container.
FIG. 5 is a side orthographic side view of a final step in the practice of my invention wherein the cap of my container is sealably secured to the container.
FIG. 6 is an orthographic view of that portion of FIG. 5 somewhat expanded to illustrate the perimeter locking of the uppermost portion of my container to the lowermost portion thereof.

With reference now to the drawings, and in particular to FIGS. 2, 3, 4, and 5 thereof, a new and improved cigarette refreshening process embodying the principles and concepts of the present invention is set forth.

More specifically, reference to FIG. 1 designates a freshener case as utilized by my invention. The refreshener case 10 is formed of an elongate lowermost portion 11 with an interfitting uppermost portion 12 attachable to said lowermost portion in an airtight sealing relationship about a complementary securable perimeter. Lowermost portion 12 has formed medially of its upper surface an upstanding conduit 13 formed with an opening 14. Configured and positioned thereto in a secured hinged relationship to conduit 13 is a securement lid 15 with an integrally formed gripping surface 16 formed within a downwardly depending locking flange for securement of lid 15 in a sealing airtight and water-tight relationship of uppermost portion of conduit 13.

Reference to FIG. 6 illustrates the air and water seal formed when uppermost portion 12 is secured to lowermost portion 11. Lowermost portion 11 is formed at its uppermost perimeter with an outwardly projecting perimeter flange 17 formed and configured in a complementary relationship to an inwardly projecting perimeter flange 18 integrally formed to uppermost portion 12. Uppermost portion 12 is accordingly formed of a material of sufficient resiliency to enable projecting flange 18 to deflect outwardly of projecting perimeter flange 17 such that when portion 17 has "ridden" over projecting flange 18, a resultant water and air tight seal is formed.

The process of my invention is practiced as follows with particular reference to FIGS. 2 through 5:

A user positions an open package of cigarettes within lowermost portion 11 and thereafter will merely secure uppermost portion 12 thereto per the mechanical interconnection as set forth above. A user then merely by utilizing moist exhaled breath from person after removing a cigarette injects through conduit 13 a volume of said exhaled breath into a chamber formed between the package of cigarettes and the uppermost surface of portion 12. It is to be understood that my refreshener case is formed of a somewhat greater internal volume than that occupied by a package of cigarettes by a ratio of approximately 1.5–2.5 to 1 to enable the presence of an additional volume of exhaled breath required to affect my invention. After said exhaled breath is injected into the uppermost chamber, as noted, securement 15 is merely attached to uppermost portion 12 and particularly to conduit 13 and an airtight chamber is formed thereby whereupon the interaction of the moist exhaled breath will refreshen the cigarettes with an additional feature of the said exhaled breath not detracting from the inherent taste and flavor of the cigarettes themselves.

It is to be understood that freshener case 10 is formed of a lowermost portion 11 of a volume to substantially encompass a package of cigarettes, as illustrated. Uppermost portion 12 when secured to lowermost portion 13 about terminal portions of their respective perimeters A an additional volume is formed, as illustrated per FIG. 5, of substantially greater volume than that requiring the housing of confinement of the cigarettes to enable creation of a freshening volume of exhaled breath to affect its enhancing process to a package of cigarettes by halting and even reversing the deterioration normal cigarettes are subject to.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A process of freshening cigarettes comprising the steps of:

positioning a package of opened cigarettes within a lowermost portion of a two-portion container wherein said lowermost portion is formed of a volume substantially proximate that of said package of cigarettes, and securing an uppermost portion of said container formed with a closable conduit in interfitting sealing engagement with said lowermost portion, and injecting a volume of exhaled breath into said container.

2. A process of freshening cigarettes as set forth in claim 1 further including the step of closing said conduit to maintain said exhaled breath in said closed container.

3. A process of freshening cigarettes as set forth in claim 1 wherein said uppermost portion is formed with an inwardly projecting flange to sealingly engage with an outwardly projecting perimeter flange integrally formed to said lowermost portion.

4. A process of freshening cigarettes as set forth in claim 1 wherein said lid is formed with a downwardly directed perimeter flange to sealingly engage said conduit.

* * * * *